US006890232B2

(12) United States Patent
Lee

(10) Patent No.: US 6,890,232 B2
(45) Date of Patent: May 10, 2005

(54) METHOD OF FABRICATING REAR PLATE IN PLASMA DISPLAY PANEL

(75) Inventor: Myung-Won Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 458 days.

(21) Appl. No.: 10/034,457

(22) Filed: Dec. 28, 2001

(65) Prior Publication Data

US 2002/0084955 A1 Jul. 4, 2002

(30) Foreign Application Priority Data

Dec. 30, 2000 (KR) ..... 2000-87094

(51) Int. Cl.[7] ..... H01J 9/00
(52) U.S. Cl. ..... 445/24
(58) Field of Search ..... 445/24, 25; 313/582–587

(56) References Cited

FOREIGN PATENT DOCUMENTS

| | | | |
|---|---|---|---|
| EP | 0924739 | 6/1999 | ..... H01J/9/20 |
| JP | 11153860 | 6/1999 | ..... G03F/7/004 |
| JP | 11250798 | 9/1999 | ..... H01J/9/02 |
| WO | WO 98/49706 | * 11/1998 | ..... H01J/9/00 |

OTHER PUBLICATIONS

W–S Jang, et. al., "A New Low–Cost Process for Fabricating a Plasma Display Back Panel," SID '99 Digest, 1036–1038 (May, 1999).

* cited by examiner

*Primary Examiner*—Joseph Williams
(74) *Attorney, Agent, or Firm*—Lee, Hong, Degerman, Kang & Schmadeka

(57) ABSTRACT

Disclosed is a method of fabricating a rear plate in a plasma display panel enabling to reduce the steps of a process, a process time, and the generation of dust. The present invention includes the steps of forming a complex functional sheet by sheeting a glazing material and a barrier rib material, attaching the complex functional sheet to a substrate, and pressing the complex functional sheet so as to form barrier ribs.

7 Claims, 7 Drawing Sheets

METHOD OF FABRICATING REAR PLATE IN PLASMA DISPLAY PANEL

CROSS REFERENCE TO RELATED ART

This application claims the benefit of Korean Patent Application No. 2000-0087094, filed on Dec. 30, 2000, the contents of which is hereby incorporated by reference in its entirety.

BACKGROUND OF THE INVENTION

1. Field of the Invention

The present invention relates to a method of fabricating a plasma display panel, and more particularly, to a method of fabricating a rear plate in a plasma display panel enabling to reduce the steps of a process, a process time, and the generation of dust.

2. Background of the Related Art

Generally, a plasma display panel (hereinafter abbreviated PDP) is manufactured by arranging cathode and anode electrodes between a pair of glass substrates confronting each other to cross each other, injecting a discharge gas between the substrates, and sealing the substrates. PDP displays a predetermined image by applying a predetermined voltage between the cathode and anode electrodes so as to bring about gas discharge at a crossing of the electrodes. PDP has been used for a monitor of OA appliance. Lately, many efforts are made to apply PDP to the wall-hanging TV and the next generation HDTV and the like with colorization. Compared to LCD, PDP provides a large-scaled screen with ease so as to expand to be applied to various fields such as various displays and the like.

FIG. 1 illustrates an AC type PDP which is widely produced.

Referring to FIG. 1, PDP includes a pair of glass substrates. In this case, a front glass substrate is called a front substrate and the other glass substrate at the rear of the front substrate is called a rear substrate 2.

On the front substrate 1 of the AC type PDP, formed are transparent electrodes 3 for discharge and bus electrodes (attached to the transparent electrodes) to reduce line resistance of the transparent electrodes 3 by bringing about discharge opposite to the transparent electrodes 3.

And, a transparent dielectric layer 4 and a protecting layer 5 to protect the electrodes are formed on the front substrate 1. The protecting layer 5 maintains a discharge state by releasing electrons during discharge so as to control an excessive discharge current. On the rear substrate 2, barrier ribs 7 as partition walls to provide discharge spaces are formed like stripes over data electrodes 6 for writing. Inside each of the discharge spaces, fluorescent layers 8 of RGB three colors are arranged regularly for luminescence and colorization of visible rays.

The front and rear substrates 2 are bonded together by a seal layer. After maintaining a vacuum state between the substrates, a gas is injected between the bonded glass substrates so as to generate ultraviolet rays during discharge. A mixed gas such as He+Xe or Ne+Xe is mainly used for the injected gas.

Modules such as driver IC and the like are installed at the above structure, thereby completing the AC type PDP.

In the AC type PDP, the barrier ribs 7 secures discharge spaces, prevents the 3-colored fluorescent layers 3 from being mixed each other, and prevents electric and optical crosstalk between discharge cells. Therefore, the barrier ribs

8 become an important factor to increase display quality and luminescence efficiency. As a panel requires large scale and high precision & resolution, many efforts are made to study the barrier ribs.

In order to fabricate the barrier ribs, there are screen printing, sand blasting, additive method, LTCCM (low temperature cofired ceramic on metal), and the like.

Screen printing carries out the steps of screen-printing a rib material and drying the printed rib material 8 to 10 times so as to stack the rib material up to a designed height. After printing the rib material, a next layer is printed thereon during a natural drying process before the previously printed rib material fails to be dried up. Thus, it is very important haw far the printed rib material runs dry. Screen printing has advantages such that a screen printer is not expensive and that the material is not wasted. Namely, the rib material is printed on the designed spots only. Yet, it is very difficult to make the heights of the respective ribs uniform due to a number of printings. Besides, the pattern of the ribs fails to meet the requirement of the product such as high precision and fine resolution.

Originally, sand blasting is used for engraving letters on a tombstone or sculpturing a glass, in which sands are jetted on a stone so that the frictional energy of the sands carves the stone. Sand blasting enables to form a micro pattern using photolithography as well as form the ribs on a large-scaled substrate. Yet, sand blasting fails to prevent cracks in the glass substrate due to the impact of an abradant thereon.

In the additive method, a photoresist film is attached on a glass substrate, and exposure and development are carried out on the photoresist film so as to leave portions of the film between patterns which will become the ribs. A rib material charges the spaces and runs dry. After removing the photoresist film, the rib material is plasticized so as to complete the ribs. Such an additive method requires no sand blaster, thereby preventing massive dusts. And, the additive method is suitable for forming the ribs on a large-scaled substrate. Yet, the additive method has difficulty in separating the photoresist from a glass paste so as to leave residues. Besides, the barrier ribs may collapse during formation.

And, compared to other methods, LTCCM has a simple process.

FIG. 2A to FIG. 2H illustrate a process of fabricating barrier ribs using LTCCM.

Referring to FIG. 2A, a green sheet 30 is prepared. The green sheet 30 is prepared by putting a slurry, which is formed by mixing glass powder, organic solvent, plasticizer, binder, additive and the like together with a predetermined ratio, on a polyester film, forming the slurry as a sheet figure by doctor blade, and carrying out a drying process thereon. A substrate 32 to which the green sheet 30 is bonded is formed of metal such as titanium. Titanium is superior to glass or ceramic material in degree of strength and thermal resistance, thereby enabling to be prepared thinner than the glass or ceramic materials as well as reduce thermal and mechanical distortion.

Referring to FIG. 2B, glass powder, which is grinded finely and dried, is sprayed on the metal substrate 32 and dried before bonding the substrate 32 and green sheet 30 together so as to ease the conjunction between the metal substrate 32 and green sheet 30. The sprayed fine glass powder is melted to be adsorbed on a surface of the substrate 32 by heat treatment at 500 to 600° C.

Referring to FIG. 2C, the green sheet 30 is bonded to the substrate 32, on which the glass powder is adsorbed, by lamination.

Referring to FIG. 2D, address electrodes 2 are patterned on the green sheet 30. The green sheet 30 is then dried.

Referring to FIG. 2E, dielectric slurry is printed on the substrate 30 on which the address electrodes 2 have been formed. And, the dielectric slurry is dried. Thus, an electrode passivation layer 36 is formed. After the formation of the electrode passivation layer 36, a second laminating is carried out so as to increase adhesiveness between the electrode passivation layer 36 and the green sheet 30 having the address electrodes 2.

In order to increase liquidity of the green sheet 30 bonded to the substrate 32, the substrate is heated at a temperature below a softening point of the organic material used as a binder.

Referring to FIG. 2F, the green sheet 30 of which liquidity is increased is aligned on a metallic pattern 38 having grooves 38*a* which have counter-figures of barrier ribs to be formed.

Referring to FIG. 2G, the metallic pattern 38 is pressed by a pressure over 150 Kgf/cm$^2$ so that the green sheet 30 and electrode passivation layer 36 fill the grooves 38*a* of the metallic pattern 38.

Referring to FIG. 2H, the metallic patter 38 is separated from the green sheet 30 and electrode passivation layer 36. Barrier ribs are then formed through heating-maintaining-cooling steps. In such a plasticizing process, after binder-burn-out by which the organic materials in the green sheet 30, crystalline nuclei grow on inorganic materials at a temperature over the burn-out temperature. After the barrier rib plasticization, a reflective layer material such as TiO2 or the like is printed and plasticized on the electrode passivation layer 36 before printing the fluorescent layer 6.

Unfortunately, the method of fabricating the barrier ribs using LTCCM according to the related art consumes too much time for preparing the conjunction of the green sheet 30 as well as has too many steps thereof. Moreover, the method according to the related art generates too much process dust, thereby deteriorating process environments.

The disadvantages and problems of the related art are explained in detail as follows.

FIG. 3 illustrates a flowchart for a process of bonding a green sheet to a substrate in a method of fabricating a rear plate in PDP using LTCCM according to a related art.

Referring to FIG. 3, glazing glass powder is reduced to fine powder by a wet or dry method to bond the green sheet 30 to the substrate 32(S31).

The finely-reduced glass powder is dried(S32). A glue organic solution and a mixed solution attained by mixing the glazing glass powder with an organic solution are sprayed (S33). And, the sprayed mixed and glue organic solutions are thermally treated(S34). It takes about 30 minutes for drying the reduced glass powder in the step S32, and about 7 to 8 hours for the thermal treatment in the step S34. Besides, dust is sprayed in a process room as the glazing glass is sprayed in the step S33, thereby deteriorating the working environments as well as endangering the safety of workers.

SUMMARY OF THE INVENTION

Accordingly, the present invention is directed to a method of fabricating a rear plate in a plasma display panel that substantially obviates one or more problems due to limitations and disadvantages of the related art.

An object of the present invention is to provide a method of fabricating a rear plate in a plasma display panel enabling to reduce the steps of a process, a process time, and the generation of dust.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method of fabricating a rear plate in a plasma display panel according to the present invention includes the steps of forming a complex functional sheet by sheeting a glazing material and a barrier rib material, attaching the complex functional sheet to a substrate, and pressing the complex functional sheet so as to form barrier ribs.

Accordingly, the present invention skips the steps of reducing/drying the glazing glass, spraying the glazing and glue materials, and treating thermally the glazing and glue materials, thereby enabling to reduce the steps of a process, a process time and prevent the generation of dust for clean working environments.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE INVENTION

A method of fabricating a rear plate in PDP according to the present invention includes the steps of forming a complex functional sheet by sheeting a glazing material, attaching the complex functional sheet to a substrate, and pressing the complex functional sheet so as to form barrier ribs.

Reference will now be made in detail to the preferred embodiments of the present invention, examples of which are illustrated in the accompanying drawings.

FIG. 4A to FIG. 4H illustrate cross-sectional views of fabricating a rear plate in PDP according to a first embodiment of the present invention.

Figure 1:
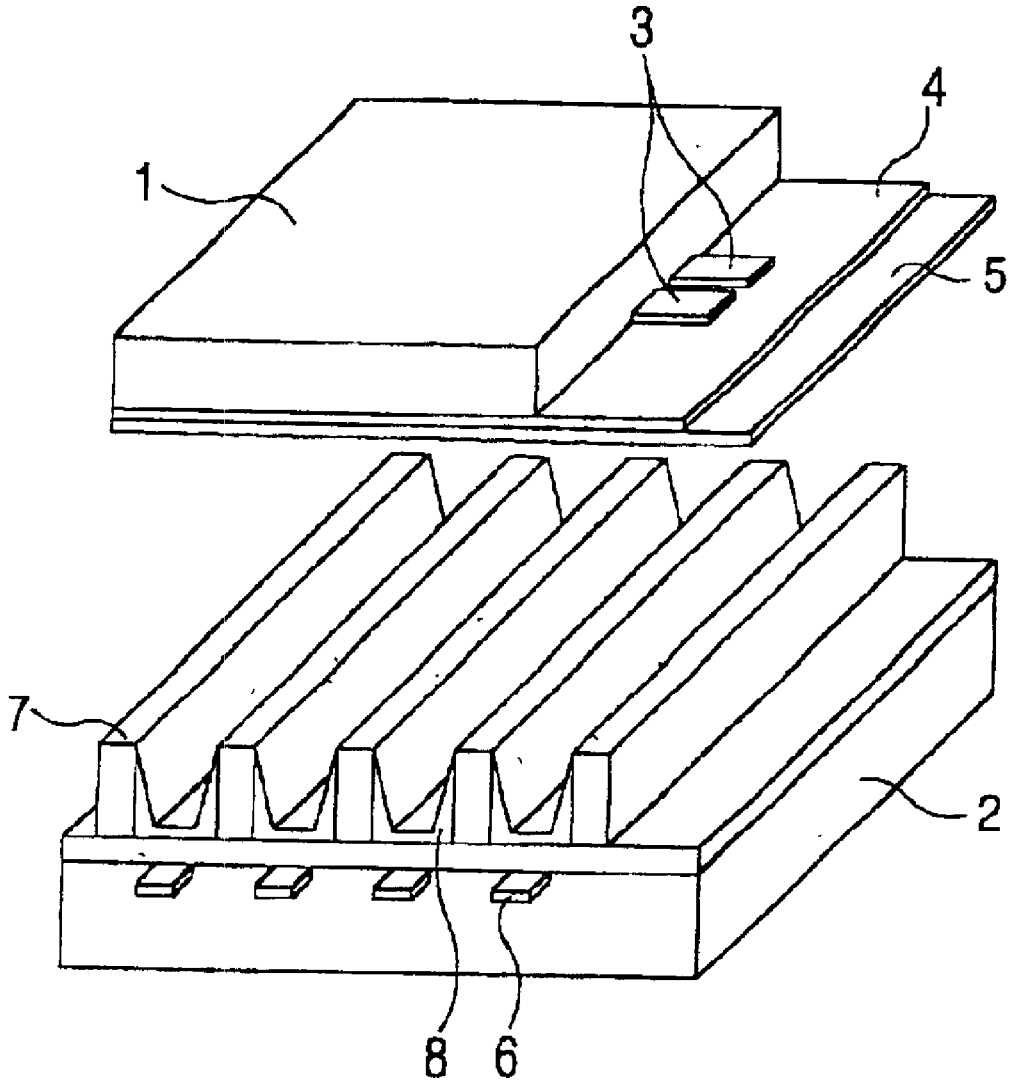
FIG. 1 CONVENTIONAL ART
FIG. 1 illustrates a general AC type surface discharge PDP.
Figure 2A:
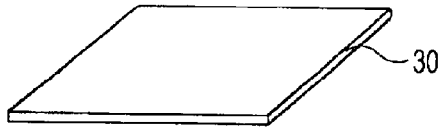
FIG.2A CONVENTIONAL ART
FIG. 2A to FIG. 2H illustrate a process of fabricating barrier ribs using LTCCM according to a related art.
Figure 2B:
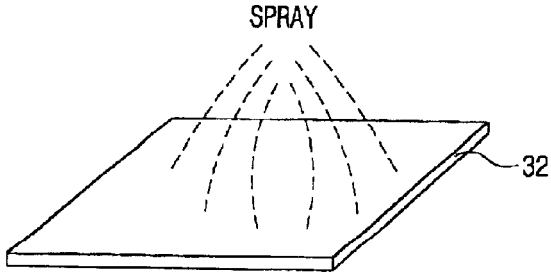
FIG.2B CONVENTIONAL ART
Figure 2C:
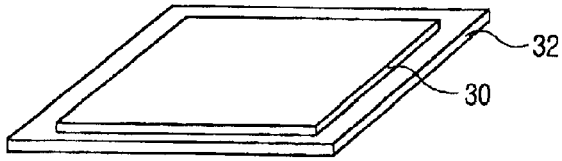
FIG.2C CONVENTIONAL ART
Figure 2D:
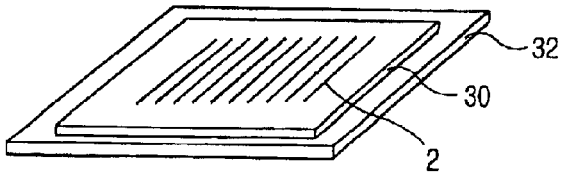
FIG.2D CONVENTIONAL ART
Figure 2E:
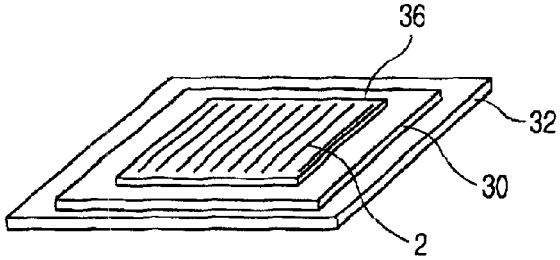
FIG.2E CONVENTIONAL ART
Figure 2F:
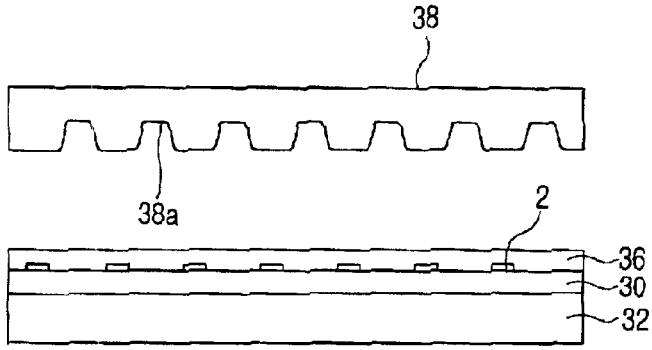
FIG.2F CONVENTIONAL ART
Figure 2G:
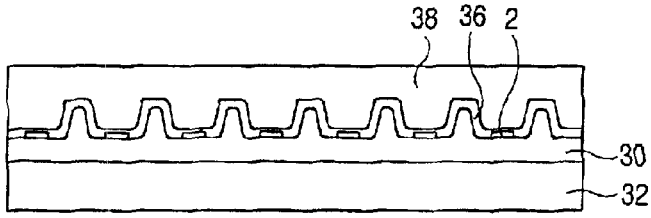
FIG.2G CONVENTIONAL ART
Figure 2H:
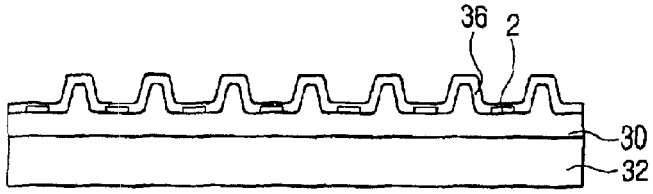
FIG.2H CONVENTIONAL ART
Figure 3:
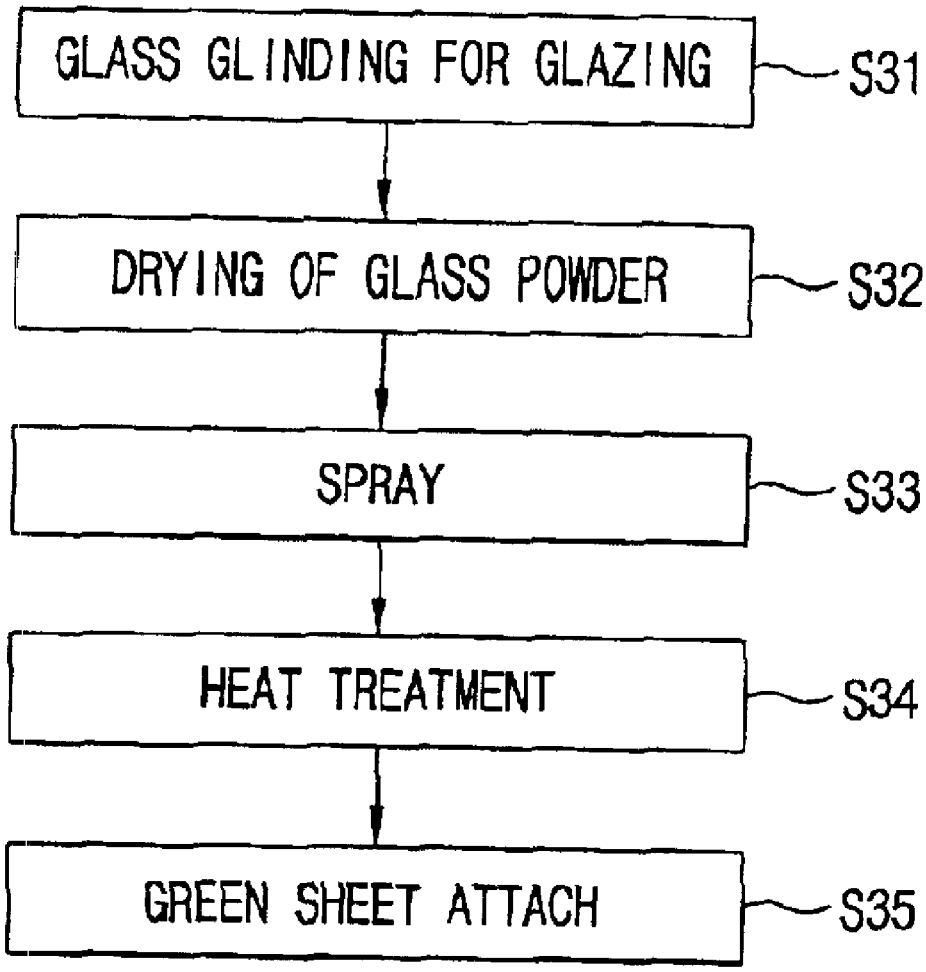
FIG. 3 illustrates a flowchart for a process of bonding a green sheet to a substrate in a method of fabricating a rear plate in PDP using LTCCM according to a related art.
Figure 4A:
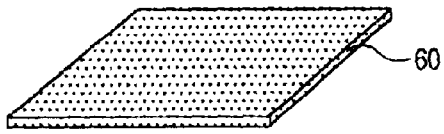
FIG. 4A to FIG. 4H illustrate cross-sectional views of fabricating a rear plate in PDP according to a first embodiment of the present invention.

Referring to FIG. 4A, a glazing/form sheet 60 having functions of a glazing and a formation of barrier ribs is prepared. The glazing/form sheet 60 is prepared by putting a slurry, which is formed by mixing glass powder for glazing, organic solvent, plasticizer, binder, additive and the like together with a predetermined ratio, on a polyester film, forming the slurry as a sheet figure by 'doctor blading', and carrying out a drying process thereon so as to have a thickness of 150~200 $\mu$m. The glazing glass powder includes MgO, $SiO_2$, ZnO, $B_2O_3$, PbO, and the like, and the organic binder includes a PVB based binder and butylbenzilphthalate (hereinafter abbreviated BBP).

Figure 4B:
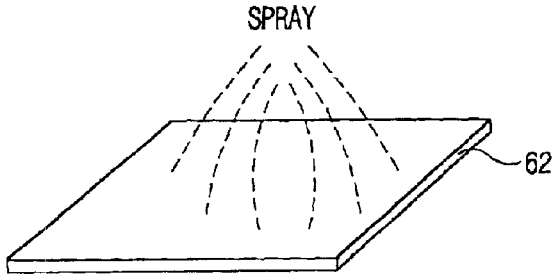
Figure 4C:
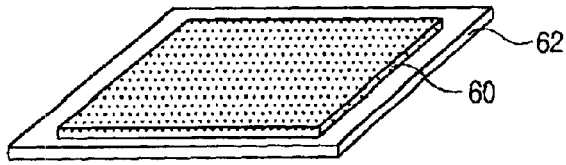

Referring to FIG. 4B, a glue organic solution is sprayed on a metal substrate 62 before bonding the metal substrate 62 and the glazing/form sheet 60 each other so as to make it easy to achieve the conjunction between the metal substrate 62 and the glazing/form sheet 60. In this case, when a glue layer is formed on a surface of the substrate, as shown in FIG. 4C, the glazing/form sheet 60 is attached to the substrate 62 by lamination.

Figure 4D:
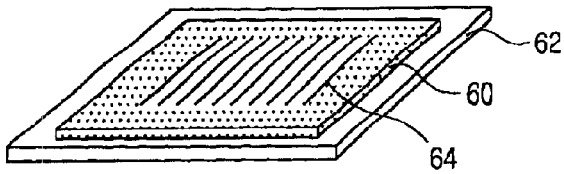

Referring to FIG. 4D, address electrodes 64 are printed on the glazing/form sheet 60, and then dried.

Figure 4E:
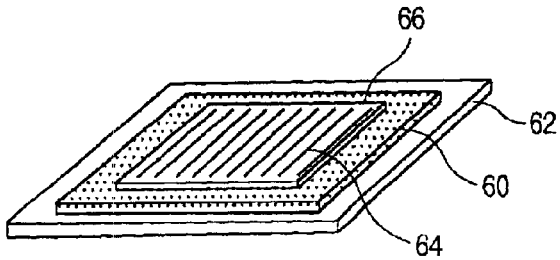

Referring to FIG. 4E, dielectric slurry is printed on the glazing/form sheet 60 on which the address electrodes 64 have been formed. And, the dielectric slurry is dried. Thus, an electrode passivation layer 66 is formed. After the formation of the electrode passivation layer 66, a second lamination is carried out so as to increase adhesiveness between the electrode passivation layer 66 and the glazing/form sheet 60 having the address electrodes 64. In order to increase liquidity of the glazing/form sheet 60 bonded to the substrate 62, the substrate 62 is heated at a temperature below a softening point of the organic binder.

Figure 4F:
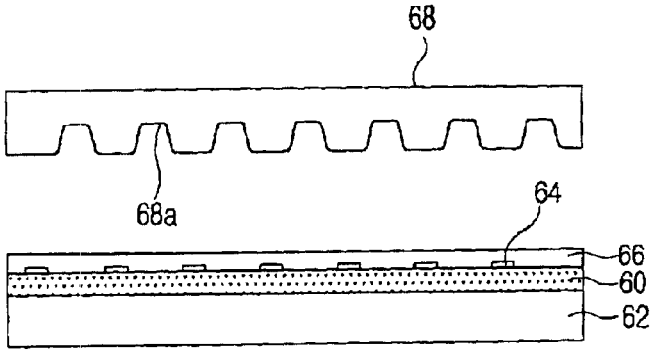

Referring to FIG. 4F, the glazing/form sheet 60 of which liquidity is increased is aligned on a metallic pattern 68 having grooves 68*a* which have counter-figures of barrier ribs to be formed.

Figure 4G:
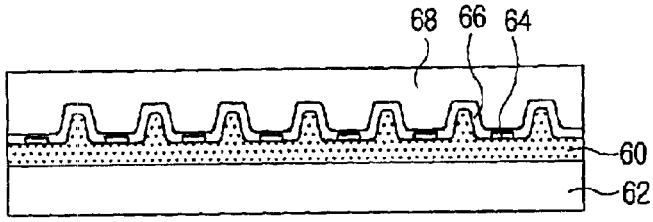

Referring to FIG. 4G, the metallic pattern 68 is pressed by a predetermined pressure so that the glazing/form sheet 60 and electrode passivation layer 66 fill the grooves 68*a* of the metallic pattern 68 by uprising.

Figure 4H:
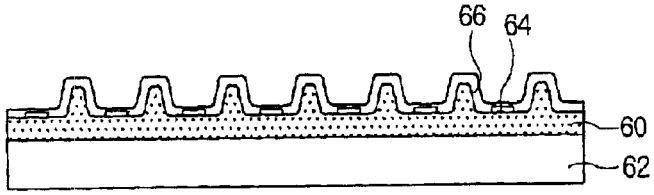

Referring to FIG. 4H, the metallic pattern 68 is separated from the glazing/form sheet 60 and electrode passivation layer 66. Barrier ribs are then formed through heating-maintaining-cooling steps for plasticization. In such a plasticizing process, after binder-burn-out by which the organic materials in the glazing/form sheet 60, crystalline nuclei grow on inorganic materials at a temperature over the burn-out temperature. After the barrier rib plasticization, a reflective layer material such as $TiO_2$ or the like is printed and plasticized on the electrode passivation layer 66 before printing the fluorescent layer.

Figure 5:
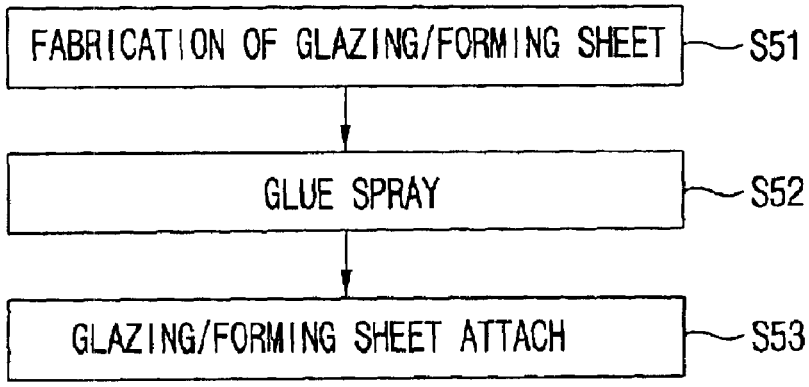
FIG. 5 illustrates a flowchart for a process of bonding a green sheet to a substrate in a method of fabricating a rear plate in PDP using LTCCM according to a first embodiment of the present invention.

FIG. 5 illustrates a flowchart for a process of bonding a green sheet to a substrate in the method of fabricating a rear plate in PDP using LTCCM according to the first embodiment of the present invention.

Referring to FIG. 5, prior to the step of bonding the glazing/form sheet 60 to the metal substrate 62, steps S51 and S52 of preparing the glazing/form sheet and spraying the glue are carried out only. Namely, the method of fabricating the rear plate in PDP according to the first embodiment of the present invention skips the steps of reducing/drying the glazing glass, spraying the glazing and glue materials, and treating thermally the glazing and glue materials in the related art.

Figure 6:
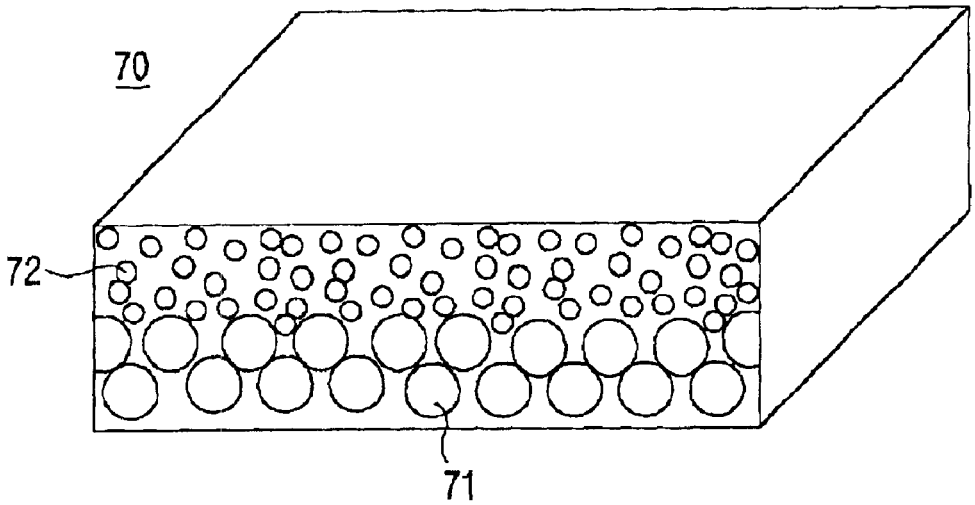
FIG. 6 illustrates a structural diagram of a glazing/form sheet applied to a method of fabricating a rear plate in PDP according to a second embodiment of the present invention.

FIG. 6 illustrates a structural diagram of a glazing/form sheet applied to a method of fabricating a rear plate in PDP according to a second embodiment of the present invention.

Referring to FIG. 6, a glazing glass powder 71 and barrier rib forming glass powder 72 differing in size are formed in different layers respectively by density difference, thereby constructing a glazing/form sheet 70.

The glazing glass powder 71 is reduced to powder so as to have a grain size over 10 $\mu$m, while the barrier rib forming glass powder 72 does to have a grain size over 2~4 $\mu$m. A composition of the glazing glass powder 71 includes MgO, PbO, and $SiO_2$, while that of the barrier rib forming glass powder 72 includes MgO, $SiO_2$, ZnO, and $B_2O_3$. Such compositions teach that the glazing glass powder 71 containing a Pb component has a density heavier than that of the barrier rib forming glass powder 72 but a softening point lower than that of the barrier rib forming glass powder 72.

The glazing/form sheet 70 is prepared by putting the glazing glass powder 71 and a slurry, which is formed by mixing glass powder for glazing, organic solvent, plasticizer, binder, additive and the like together with a predetermined ratio, on a polyester film, forming a sheet figure by 'doctor blading', and carrying out a drying process thereon so as to have a thickness of 150~200 $\mu$m. In this case, the organic binder includes a PVB based binder and BBP.

A glue organic solution is sprayed and dried on a substrate 62 before bonding the metal substrate 62 and the glazing/form sheet 70 each other. The glazing/form sheet 70 is then attached to the substrate 62 by lamination. Namely, in the glazing/form sheet 70 attached to the metal substrate 62, a glazing material layer and a barrier forming material layer are stacked in order.

Address electrodes 64 and an electrode passivation layer 66 are then formed on the glazing/form sheet 70 in order.

When a metallic pattern 68 is pressed by a predetermined pressure to form barrier ribs, the barrier rib forming material layer of the glazing/form sheet 70 and the electrode passivation layer 66 fill the grooves 68*a* of the metallic pattern 68 by uprising. Barrier ribs are then formed through plasticization. And, the barrier ribs are coated with a fluorescent layer.

In the method of fabricating the rear plate according to the second embodiment of the present invention, the barrier rib formation is achieved with ease by the glazing material layer and barrier rib forming material layer of the glazing/form sheet 70 of which two layers are separated by lamination. And, amount of contraction is reduced.

Moreover, as shown in FIG. 5, prior to the step of bonding the glazing/form sheet 70 to the metal substrate 62, steps S51 and S52 of preparing the glazing/form sheet and spraying the glue are carried out only.

Accordingly, the present invention skips the steps of reducing/drying the glazing glass, spraying the glazing and glue materials, and treating thermally the glazing and glue materials, thereby enabling to reduce the steps of a process, a process time and prevent the generation of dust for clean working environments.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A method of fabricating a rear plate in a plasma display panel, comprising the steps of:

forming a slurry by mixing a glazing material having different densities and a barrier rib material;

forming a complex functional sheet by forming the slurry, the complex functional sheet including a glazing layer and a barrier rib layer on the glazing layer which are separately formed by the density difference of the glazing material and barrier rib material;

attaching the complex functional sheet to a substrate; and pressing the complex functional sheet so as to form barrier ribs.

2. The method of claim 1, further comprising a step of spraying a glue material on the substrate before the step of attaching the complex functional sheet to a substrate, wherein the glue material forms an interface between the complex functional sheet and the substrate.

3. The method of claim 1, wherein barrier rib forming glass is added to the complex functional sheet with a predetermined ratio.

4. The method of claim 3, wherein the barrier rib forming glass is reduced to powder of which grain size is greater than 2–4 $\mu$m.

5. The method of claim 3, wherein a layer separation occurs between the glazing material and the barrier rib material by a density difference when the complex functional sheet is attached to the substrate.

6. The method of claim 1, wherein the glaze material includes glass glaze.

7. The method of claim 6, wherein the glaze glass is reduced to powder of which grain size is over 10 $\mu$m.

* * * * *